United States Patent [19]

Arakawa et al.

[11] Patent Number: 4,571,496

[45] Date of Patent: Feb. 18, 1986

[54] RADIATION IMAGE STORAGE PANEL

[75] Inventors: Satoshi Arakawa; Hisashi Yamazaki; Kikuo Yamazaki; Terumi Matsuda, all of Kaisei, Japan

[73] Assignee: Fuji Photo Film Co., Ltd., Japan

[21] Appl. No.: 575,669

[22] Filed: Jan. 31, 1984

[30] Foreign Application Priority Data

Jan. 31, 1983 [JP] Japan ..... 58-14189

[51] Int. Cl.[4] ..... G21K 4/00

[52] U.S. Cl. ..... 250/484.1; 250/486.1

[58] Field of Search ..... 250/337, 327.2, 484.1, 250/486.1

[56] References Cited

U.S. PATENT DOCUMENTS 4,039,840 8/1977 Shimiya et al. ..... 250/486.1

4,394,581 7/1983 Takahashi et al. ..... 250/484.1

4,472,635 9/1984 Yokota et al. ..... 250/486.1

4,486,486 12/1984 Maeoka et al. ..... 250/486.1

*Primary Examiner*—Carolyn E. Fields

*Attorney, Agent, or Firm*—Murray, Whisenhunt and Ferguson

[57] ABSTRACT

A radiation image storage panel comprising a support and phosphor layers provided thereon which comprise a binder and a stimulable phosphor dispersed therein, characterized in that said phosphor layers comprise the first phosphor layer on the support side and the second phosphor layer provided on the first phosphor layer, and that the mean particle size of the stimulable phosphor contained in said first phosphor layer is smaller than the mean particle size of the stimulable phosphor contained in said second phosphor layer.

10 Claims, 6 Drawing Figures

(1)

RADIATION IMAGE STORAGE PANEL

BACKGROUND OF THE INVENTION

1. Field of the Invention

This invention relates to a radiation image storage panel and more particularly, to a radiation image storage panel comprising a support and phosphor layers provided thereon which comprise a binder and a stimulable phosphor dispersed therein.

2. Description of Prior Arts

For obtaining a radiation image, there has been conventionally employed a radiography utilizing a combination of a radiographic film having an emulsion layer containing a photosensitive silver salt material and a radiographic intensifying screen.

As a method replacing the above-described radiography, a radiation image recording and reproducing method utilizing a stimulable phosphor as described, for instance, in U.S. Pat. No. 4,239,968, has been recently paid much attention. In the radiation image recording and reproducing method, a radiation image storage panel comprising a stimulable phosphor (i.e., stimulable phosphor sheet) is used, and the method involves steps of causing the stimulable phosphor of the panel to absorb radiation energy having passed through an object or having radiated from an object; exciting the stimulable phosphor with an electromagnetic wave such as visible light and infrared rays (hereinafter referred to as "stimulating rays") to sequentially release the radiation energy stored in the stimulable phosphor as light emission (stimulated emission); photoelectrically converting the emitted light to give electric signals; and reproducing the electric signals as a visible image on a recording material such as a photosensitive film or on a displaying device such as CRT.

In the above-described radiation image recording and reproducing method, a radiation image can be obtained with a sufficient amount of information by applying a radiation to the object at considerably smaller dose, as compared with the case of using the conventional radiography. Accordingly, this radiation image recording and reproducing method is of great value especially when the method is used for medical diagnosis.

The radiation image storage panel employed in the above-described radiation image recording and reproducing method has a basic structure comprising a support and a phosphor layer provided on one surface of the support. Further, a transparent film is generally provided on the free surface (surface not facing the support) of the phosphor layer to keep the phosphor layer from chemical deterioration or physical shock.

The phosphor layer comprises a binder and stimulable phosphor particles dispersed therein. The stimulable phosphor emits light (stimulated emission) when excited with stimulating rays after having been exposed to a radiation such as X-rays. Accordingly, the radiation having passed through an object or having radiated from an object is absorbed by the phosphor layer of the radiation image storage panel in proportion to the applied radiation dose, and a radiation image of the object is produced in the radiation image storage panel in the form of a radiation energy-stored image (latent image). The radiation energy-stored image can be released as stimulated emission (light emission) by applying stimulating rays to the panel, for instance, by scanning the panel with stimulating rays. The stimulated emission is then photoelectrically converted to electric signals, so as to produce a visible image from the radiation energy-stored image.

It is desired for the radiation image storage panel employed in the radiation image recording and reproducing method to have a high sensitivity and to provide an image of high quality (high sharpness, high graininess, etc.).

As one of factors to determine the sensitivity of a radiation image storage panel and the quality of the image provided thereby, there is mentioned particle size of a stimulable phosphor employed in the panel. More in detail, the employment of a stimulable phosphor having a larger particle size in the radiation image storage panel generally brings about enhancement in the sensitivity of the panel as well as deterioration of the quality of the image provided by the panel. On the contrary, the employment of a stimulable phosphor having a smaller particle size in the panel brings about enhancement in the quality of the image as well as deterioration of the sensitivity.

SUMMARY OF THE INVENTION

It is an object of the present invention to provide a radiation image storage panel improved in not only the sensitivity thereof but also the quality of the image provided thereby, particularly the sharpness.

The above-mentioned object can be accomplished by a radiation image storage panel of the present invention comprising a support and phosphor layers provided thereon which comprise a binder and a stimulable phosphor dispersed therein, characterized in that said phosphor layers comprise the first phosphor layer on the support side and the second phosphor layer provided on the first phosphor layer, and that the mean particle size of the stimulable phosphor contained in said first phosphor layer is smaller than the mean particle size of the stimulable phosphor contained in said second phosphor layer.

In the present invention, the mean particle size (diameter) of a stimulable phosphor means a weight-average particle size.

Figure 2:
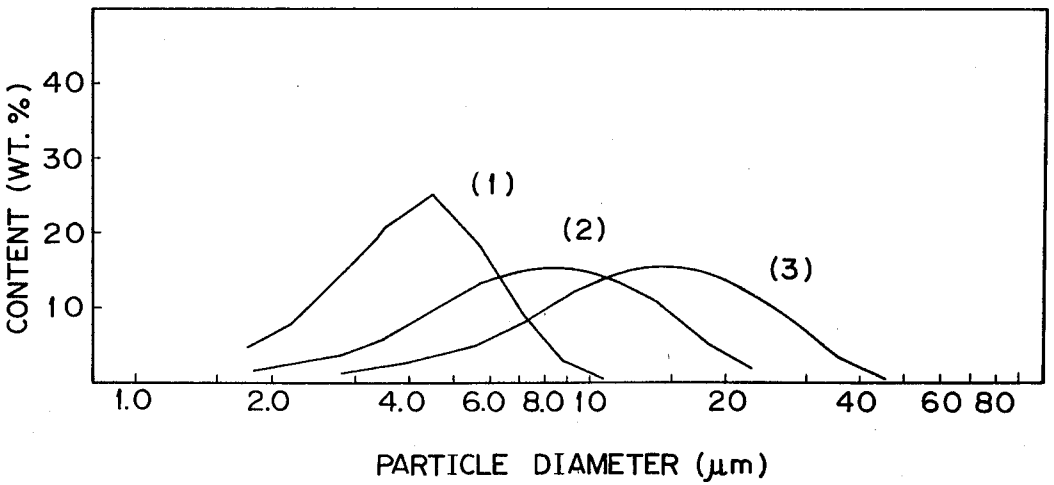

a: support, $b_1$: first phosphor layer, $b_2$: second phosphor layer, c: protective film, $d_1$: colored first phosphor layer, $d_2$: colored second phosphor layer FIG. 2 graphically illustrates particle size distributions of the stimulable phosphors employed in the radiation image storage panel according to the present invention.

Figure 3:
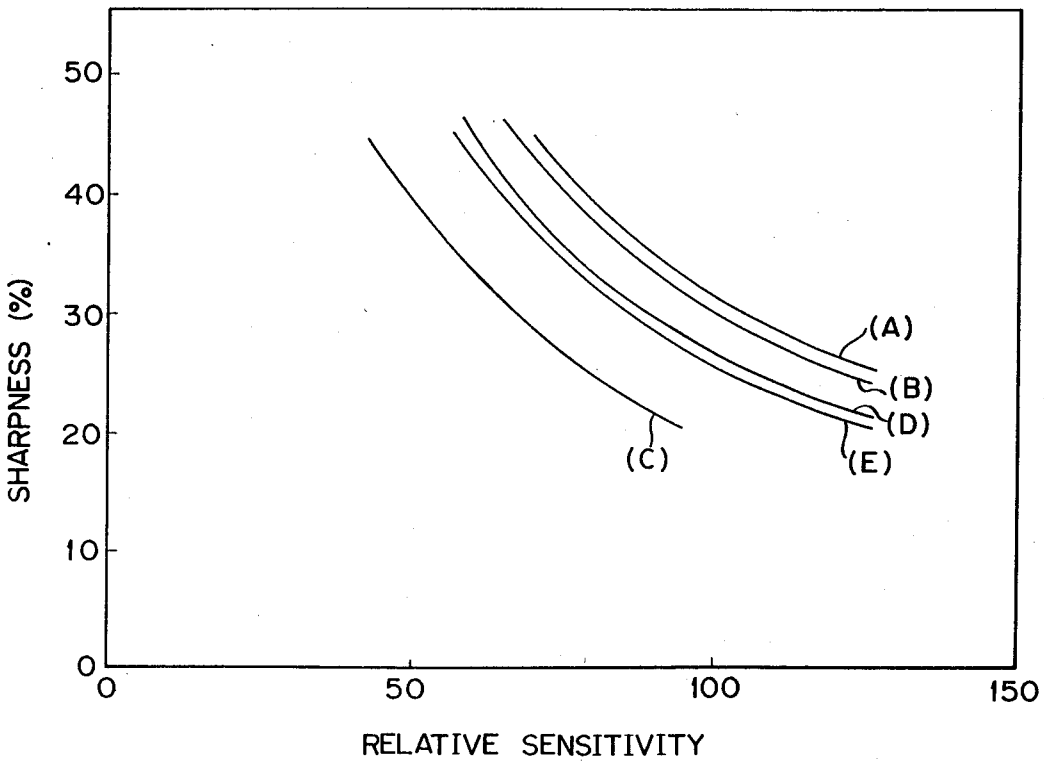

FIG. 3 graphically illustrates relationships between a relative sensitivity and a sharpness in the radiation image storage panels according to the present invention [Curves (A) and (B)], and relationships between a relative sensitivity and a sharpness in the conventional radiation image storage panels [Curves (C) to (E)].

Figure 4:
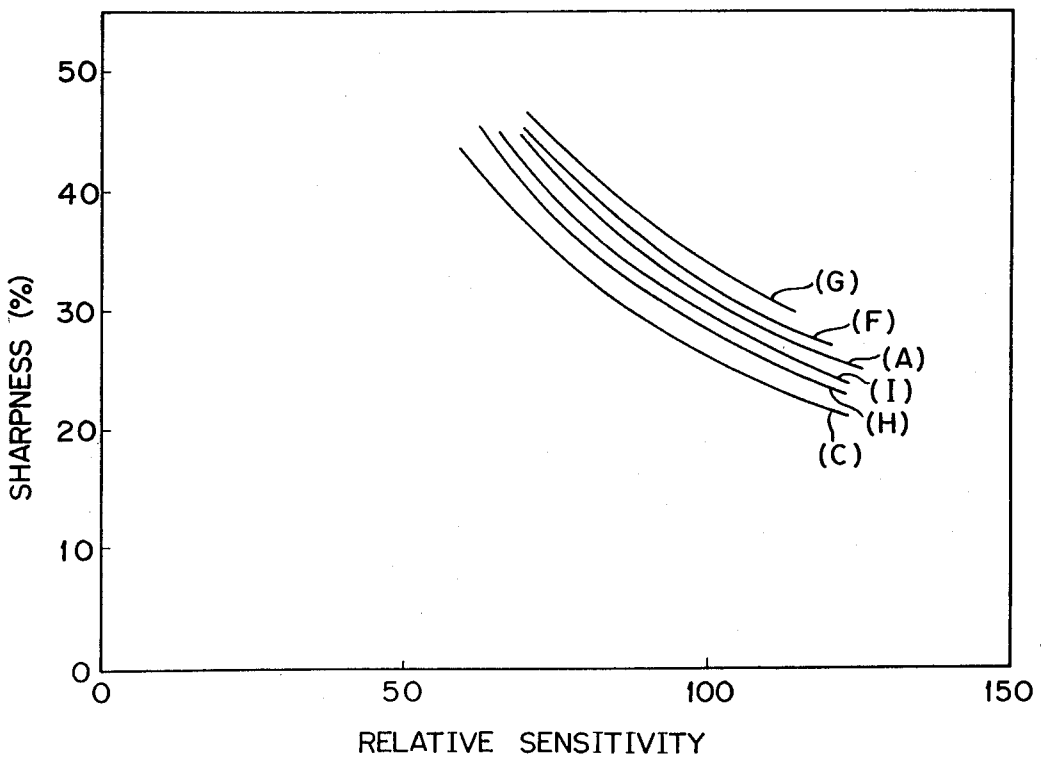

FIG. 4 graphically illustrates relationships between a relative sensitivity and a sharpness in the radiation image storage panels according to the present invention [Curves (A), (F) and (G)], and relationships between a relative sensitivity and a sharpness in the radiation image storage panels for comparison [Curves (C), (H) and (I)].

DETAILED DESCRIPTION OF THE INVENTION

In the radiation image storage panel of the present invention, phosphor layers provided on a support are composed of two layers and the mean particle size of stimulable phosphor contained in the first phosphor layer on the support side is smaller than the mean particle size of stimulable phosphor contained in the second phosphor layer provided on the first phosphor layer, whereby it can be accomprished to enhance the quality of an image provided by the panel, particularly the sharpness, without decreasing the sensitivity of the panel.

The decrease of the sharpness of the image provided by a radiation image storage panel is caused by the fact that stimulating rays having entered from the surface of panel (surface of the second phosphor layer or surface of a protective film in the case that a protective film is provided on the second phosphor layer) spread through scattering thereof, etc., in the vicinity of the surface of the support. Further, the spread of stimulating rays is also caused by reflection on the interface between the phosphor layer and the support. The decrease of sharpness caused by the spread of stimulating rays can be prevented by employing a stimulable phosphor having a small mean particle size for the first phosphor layer on the support side according to the present invention. The reason why the above prevention is attained is presumed that the stimulating rays having entered the first phosphor layer or having been reflected on the interface between the first phosphor layer and the support can be multi-scattered in a local area of the first phosphor layer containing a large number of phosphor particles having a small size, and accordingly the mean free of the stimulating rays is shortened.

On the first phosphor layer further provided is the second phosphor layer containing a stimulable phosphor having a relatively large mean particle size, whereby both the enhancement in the sensitivity of the panel arising from the phosphor particles having a larger size and the enhancement in the quality of the image provided thereby arising from the phosphor particles having a smaller size can be effectively accomplished. Furthermore, by varying the thickness of each phosphor layer, the balance between the sensitivity and the quality of the image in the resulting radiation image storage panel can be varied appropriately.

Accordingly, the present invention provides a radiation image storage panel remarkably enhanced in the sharpness of the image in the case that the panel has the same sensitivity as the conventional radiation image storage panel. On the other hand, the present invention provides a radiation image storage panel remarkably enhanced in the sensitivity in the case that the panel provides the image of the same sharpness as the conventional radiation image storage panel.

In addition, the present invention provides a radiation image storage panel in which the first phosphor layer and/or the second phosphor layer are so colored as to absorb at least a portion of stimulating rays.

That is, the sharpness of the image provided by the panel can be further enhanced by coloring the phosphor layer with a colorant capable of selectively absorbing the stimulating rays, because the spread of the stimulating rays caused by the reflection on the interface between the support and the phosphor layer can be prevented.

Representative embodiments of the radiation image storage panel of the present invention having the above-described preferable characteristics will be described hereinafter by referring to FIG. 1.

Figure 1:
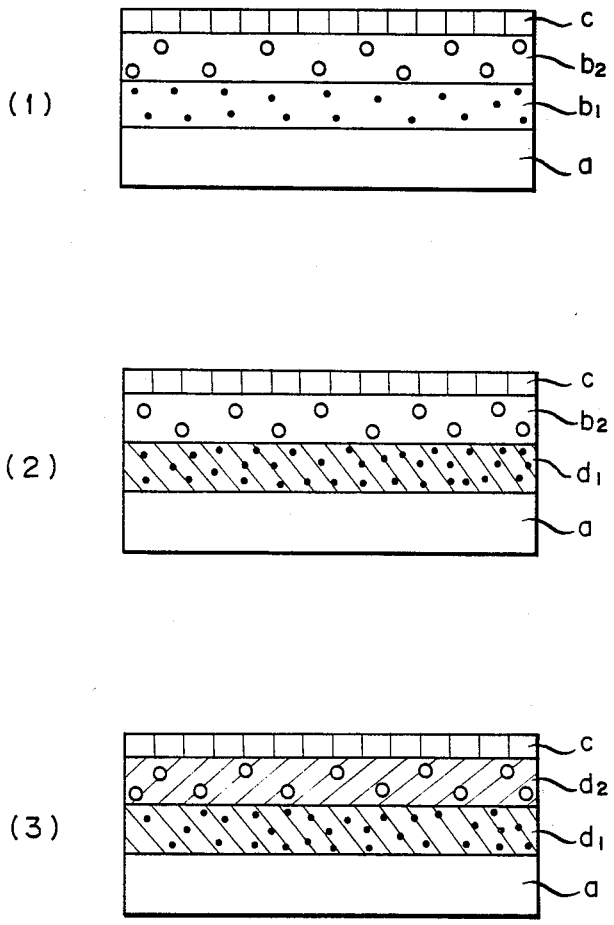
FIG. 1 shows vertical sectional views of the examples of the radiation image storage panels according to the present invention.

FIG. 1 shows vertical sectional views (1)–(3) of examples of the radiation image storage panels according to the present invention.

The sectional view (1) of FIG. 1 shows a radiation image storage panel comprising a support (a), the first phosphor layer ($b_1$) containing a stimulable phosphor having a relatively small mean particle size, the second phosphor layer ($b_2$) containing a stimulable phosphor having a relatively large mean particle size and a protective film (c), being superposed in this order.

The sectional view (2) of FIG. 1 shows a radiation image storage panel comprising a support (a), the colored first phosphor layer ($d_1$) containing a stimulable phosphor having a relatively small mean particle size, the second phosphor layer ($b_2$) containing a stimulable phosphor having a relatively large mean particle size and a protective film (c), being superposed in this order.

The sectional view (3) of FIG. 1 shows a radiation image storage panel comprising a support (a), the colored first phosphor layer ($d_1$) containing a stimulable phosphor having a relatively small mean particle size, the colored second phosphor layer ($d_2$) containing a stimulable phosphor having a relatively large mean particle size and a protective film (c), being superposed in this order.

Each of the sectional views (1) through (3) of FIG. 1 shows a basic structure of the radiation image storage panel. The above-described structures are given by no means to restrict the radiation image storage panel of the present invention, but the panel of the present invention can be in the form of any other radiation image storage panel having a variety of structures such as a structure including a subbing layer provided between optionally selected layers.

The radiation image storage panels of the present invention having the above-described structures can be prepared, for instance, in the following manner.

The support material employed in the present invention can be selected from those employed in the conventional radiographic intensifying screens or those employed in the known radiation image storage panels. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From a viewpoint of characteristics of a radiation image storage panel as an information recording material, a plastic film is preferably employed as the support material of the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the preparation of a known radiation image storage panel, one or more additional layers are occasionally provided between the support and the phosphor layer so as to enhance the adhesion between the support and the phosphor layer, or to improve the sensitivity of the panel or the quality of an image provided thereby. For instance, a subbing layer or an adhesive layer may be provided by coating polymer material such as gelatin over the surface of the support on the phosphor layer side. Otherwise, a light-reflecting layer or a light-absorbing layer may be provided by forming a polymer material layer containing a light-reflecting material such as titanium dioxide or a light-absorbing material such as carbon black. In the invention, one or more of these additional layers may be provided depending on the type of the radiation image storage panel to be obtained.

As described in Japanese patent application No. 57(1982)-82431 (corresponding to U.S. patent application No. 496,278 and European patent Publication No. 92241), the phosphor layer side surface of the support (or the surface of an adhesive layer, light-reflecting layer, or light-absorbing layer in the case where such layers provided on the phosphor layer) may be provided with protruded and depressed portions for enhancement of the sharpness of radiographic image.

On the support prepared as described above, phosphor layers are formed. The phosphor layer comprises a binder and stimulable phosphor particles dispersed therein. In the present invention, as descrived hereinbefore, the phosphor layers comprise two layers, namely the first phosphor layer and the second phosphor layer.

The stimulable phosphor, as described hereinbefore, give stimulated emission when excited with stimulating rays after exposure to a radiation. In the viewpoint of practical use, the stimulable phosphor is desired to give stimulated emission in the wavelength region of 300–500 nm when excited with stimulating rays in the wavelength region of 400–850 nm.

Examples of the stimulable phosphor empolyable in the radiation image storage panel of the present invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaO.xAl_2O_3$:Eu, in which x is a number satisfying the condition of $0.8 \leqq x \leqq 10$, and $M^{2+}O.xSiO_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,326,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in the above-mentioned U.S. Pat. No. 4,236,078;

$(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in Japanese Patent Provisional Publication No. 55(1980)-12145;

The above-described stimulable phosphors are given by no means to restrict the stimulable phosphor employable in the present invention. Any other phosphors can be also employed, provided that the phosphor gives stimulated emission when excited with stimulating rays after exposure to a radiation.

However, as for the particle size of the stimulable phosphor, that is a characteristic requisite of the present invention, it is required that the mean particle size of stimulable phosphor contained in the first phosphor layer provided on the support is smaller than the means particle size of stimulable phosphor contained in the second phosphor layer provided on the first phosphor layer.

It is preferred that the mean particle sizes of stimulable phosphors contained in the first phosphor layer and the second phosphor layer are within the range of 0.5–10 μm and 1–50 μm, respectively, and that the deviation between both the mean particle sizes thereof is not less than 2 μm. More preferable is within the range of 1–8 μm and 4–30 μm, respectively.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polymethyl methacrylate, vinyl chloride-vinyl acetate copoymer, polyurethane, cellulose acetate butyrate, polyvinyl alcohol, and linear polyester. Particularly preferred are nitrocellulose, linear polyester, and a mixture of nitrocellulose and linear polyester.

The first phosphor layer can be formed on the support, for instance, by the following procedure.

In the first place, stimulable phosphor particles and a binder are added to an appropriate solvent, and then they are mixed to prepare a coating dispersion of the phosphor particles in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The ratio between the binder and the stimulable phosphor in the coating dispersion may be determined according to the characteristics of the aimed radiation image storage panel and the nature of the phosphor employed. Generally, the ratio therebetween is within the range of from 1:1 to 1:100 (binder:phosphor, by weight), preferably from 1:8 to 1:40.

The coating dispersion may contain a dispersing agent to assist the dispersibility of the phosphor particles therein, and also contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly to the surface of a support to form a layer of the coating dispersion. The coating procedure can be carried out by a conventional method such as a method using a doctor blade, a roll coater or a knife coater.

After applying the coating dispersion to the support, the coating dispersion is then heated slowly to dryness so as to complete the formation of the first phosphor layer. The thickness of the first phosphor layer varies depending upon the characteristics of the aimed radiation image storage panel, the nature of the phosphor, the ratio between the binder and the phosphor, etc. Generally, the thickness of the first phosphor layer is within the range of from 20 to 500 μm.

The first phosphor layer can be provided onto the support by the methods other than that given in the above. For instance, the phosphor layer is initially prepared on a sheet material (false support) such as a glass plate, a metal plate or a plastic sheet using the aforementioned coating dispersion and then thus prepared phosphor layer is superposed on the genuine support by pressing or using an adhesive agent.

From the viewpoint of the sharpness of the image provided by the panel, as described above, it is desired that the first phosphor layer is colored with such a colorant as selectively absorbs the stimulating rays to be applied to the panel.

The colorant employable in the radiation image storage panel of the present invention is required to absorb at least a portion of the stimulating rays. The colorant preferably has the absorption characteristics that the means absorption coefficient thereof in the wavelength region of the stimulating rays for the stimulable phosphors contained in the first and second phosphor layers is higher than the mean absorption coefficient thereof in the wavelength region of the light emitted by said stimulable phosphors upon stimulation thereof. From the viewpoint of the sharpness of the image provided by the panel, it is desired that the mean absorption coefficient of the first phosphor layer in the wavelength region of the stimulating rays for the stimulable phosphors contained in the first and second phosphor layers is as high as possible. On the other hand, from the viewpoint of the sensitivity of the panel, it is desired that the mean absorption coefficient of the first phosphor layer in the wavelength region of the light emitted by said stimulable phosphors upon stimulation thereof is as low as possible.

Accordingly, the preferred colorant depends on the stimulable phosphor employed in the radiation image storage panel. In the viewpoint of practical use, the stimulable phosphor is desired to give stimulated emission in the wavelength region of 300–500 nm when excited with stimulating rays in the wavelength region of 400–850 nm as described above. Employable for such a stimulable phosphor is a colorant having a body color ranging from blue to green so that the mean absorption coefficient thereof in the wavelength region of the stimulating rays for the phosphor is higher than the mean absorption coefficient thereof in the wavelength region of the light emitted by the phosphor upon stimulation and that the difference therebetween is as large as possible.

Examples of the colorant employed in the invention include the colorants disclosed in Japanese Patent Provisional Publication No. 55(1980)-163500 (corresponding to U.S. Pat. No. 4394581 and European Patent Publication No. 21174), that is: organic colorants such as Zapon Fast Blue 3G (available from Hoechst AG), Estrol Brill Blue N-3RL (available from Sumitomo Chemical Co., Ltd., Japan), Sumiacryl Blue F-GSL (available from Sumitomo Chemical Co., Ltd.), D & C Blue No. 1 (available from National Aniline), Spirit Blue (available from Hodogaya Chemical Co., Ltd., Japan), Oil Blue No. 603 (available from Orient Co., Ltd.), Kiton Blue A (available from Ciba-Geigy), Aizen Cathilon Blue GLH (available from Hodogaya Chemical Co, Ltd.), Lake Blue A.F.H (available from Kyowa Sangyo Co., Ltd., Japan), Rodalin Blue 6GX (available from Kyowa Sangyo Co., Ltd.), Primocyanine 6GX (available from Inahata Sangyo Co., Ltd., Japan), Brillacid Green 6BH (available from Hodogaya Chemical Co., Ltd.), Cyanine Blue BNRS (available from Toyo Ink Mfg. Co., Ltd., Japan), Lionol Blue SL (available from Toyo Ink Mfg. Co., Ltd.), and the like; and inorganic colorants such as ultramarine blue, cobalt blue, cerulean-blue, chromium oxide, $TiO_2$—ZnO-CoO-NiO pigment, and the like.

Examples of the colorant employable in the present invention also include the colorants described in the Japanese patent application No. 55(1980)-171545 (corresponding to U.S. Pat. No. 4,491,736), that is: organic metal complex salt colorants having Color Index No. 24411, No. 23160, No. 74180, No. 74200, No. 22800, No. 23150, No. 23155, No. 24401, No. 14880, No. 15050, No. 15706, No. 15707, No. 17941, No. 74220, No. 13425, No. 13361, No. 13420, No. 11836, No. 74140, No. 74380, No. 74350, No. 74460, and the like.

Among the above-mentioned colorants having a body color from blue to green, particularly preferred are the organic metal complex salt colorants which show no emission in the longer wavelength region than that of the stimulating rays as described in the latter Japanese Patent Application No. 55(1980)-171545.

Then, on the first phosphor layer is formed the second phosphor layer.

The second phosphor layer is formed in the same manner as described above employing the aforementioned stimulable phosphor, binder and solvent, and various additives such as a dispersing agent and a plasticizer can be optionally added. Accordingly, there is no specific limitation on the kind of stimulable phosphor, binder, solvent or the like employable for the formation of the second phosphor layer, and they may be the same or different from those employed for the formation of the first phosphor layer.

However, from the viewpoint of the sensitivity of the resulting radiation image storage panel, the mean particle size of stimulable phosphor contained in the second phosphor layer is required to be larger than the mean particle size of stimulable phosphor contained in the first phosphor layer as described hereinbefore.

The mixing ratio between the binder and the stimulable phosphor in the coating dispersion for the formation of the second phosphor layer and the thickness thereof are within the range mentioned on the first phosphor layer. The ratio of the thickness between the first phosphor layer and the second phosphor layer is preferably within the range of from 1:9 to 9:1.

For the purpose of further enhancing the sharpness of the image, the second phosphor layer may be also colored with such a colorant as selectively absorbs the stimulating rays in the case that the first phosphor layer is colored as described above. In brief, both of the first phosphor layer and second phosphor layer may be colored with the aforementioned colorant.

In this case, from the viewpoint of the sensitivity, the second phosphor layer must be colored in the lower color density than that of the first phosphor layer in order to prevent the reduction of light (stimulated emission) emitted by the stimulable phosphors contained in the first and second phosphor layers, which is caused by the absorption of stimulating rays entering from the surface of the radiation image storage panel in the colored second phosphor layer.

When the second phosphor layer is formed directly on the first phosphor layer through a coating procedure, the binder and solvent employed for the second phosphor layer are preferably different from those employed for the formation of the first phosphor layer so as not to dissolve the surface of the prepared first phosphor layer.

The phosphor layers can be formed on the support, for instance, by procedures of simultaneous coating and forming of the two layers, as well as the above-described successive coating and forming procedures of the first phosphor layer and second phosphor layer in this order.

According to the process for the preparation as described above, a radiation image storage panel of the present invention comprising a support, the first phosphor layer and the second phosphor layer can be prepared.

The radiation image storage panel generally has a transparent film on a free surface of a phosphor layer to protect the phosphor layer from physical and chemical deterioration. In the radiation image storage panel of the present invention, it is preferable to provide a transparent film for the same purpose.

The transparent film can be provided onto the phosphor layer by coating the surface of the phosphor layer with a solution of a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer), and drying the coated solution. Alternatively, the transparent film can be provided onto the phosphor layer by beforehand preparing it from a polymer such as polyethylene terephthalate, polyethylene, polyvinylidene chloride or polyamide, followed by placing and fixing it onto the phosphor layer with an appropriate adhesive agent. The transparent protective film preferably has a thickness within a range of approx. 3 to 20 μm.

The following examples further illustrate the present invention, but these examples are by no means understood to restrict the invention.

EXAMPLES 1 AND 2

As stimulable phosphors were employed three kinds of divalent europium activated barium fluorobromide phosphors having a mean particle size different from each other, that is, the phosphor having a mean particle size of approx. 4.5 μm (Phosphor I), the phosphor having a mean particle size of approx. 8 μm (Phosphor II) and the phosphor having a mean particle size of approx. 14 μm (Phosphor III). The particle size distributions of Phosphors I to III are graphically illustrated in FIG. 2, which respectively correspond to Curves (1) to (3).

Preparation of Radiation Image Storage Panel

To a mixture of Phosphor I and polyurethane were added toluene and ethanol to prepare a dispersion containing the phosphor particles and the binder in the ratio of 20:1 (phosphor:binder, by weight). Subsequently, tricresyl phosphate was added to the dispersion and the mixture was sufficiently stirred by means of a propeller agitater to obtain a homogeneous coating dispersion having a viscosity of 25–35 PS (at 25° C.).

Then the coating dispersion was applied to a polyethylene terephthalate sheet containing carbon black (support, thickness: 250 μm) placed horizontally on a glass plate. The application of the coating dispersion was carried out using a doctor blade. After the coating was complete, the support having the coating dispersion was placed in an oven and heated at a temperature gradually rising from 25° to 100° C. Thus, a phosphor layer (first phosphor layer) having the thickness of approx. 150 μm was formed on the support.

Independently, to a mixture of Phosphor II (or Phosphor III) and a linear polyester resin were added successively methyl ethyl ketone and nitrocellulose (nitrification degree: 11.5%), to prepare a dispersion containing the phosphor particles and the binder in the ratio of 20:1 (phosphor:binder, by weight). Subsequently, tricresyl phosphate, n-butanol and methyl ethyl ketone were added to the dispersion. The mixture was sufficiently stirred by means of a propeller agitater to obtain a homogeneous coating dispersion having a viscosity of 25–35 PS (at 25° C.).

The coating dispersion was applied onto the previously formed first phosphor layer in the same manner as described above to form a phosphor layer (second phosphor layer) having the thickness of approx. 150 μm.

On the second phosphor layer was placed a polyethylene terephthalate transparent film (thickness: 12 μm; provided with a polyester adhesive layer on one surface) to combine the film and the second phosphor layer with the adhesive layer. Thus, a radiation image storage panel consisting essentially of a support, the first phosphor layer, the second phosphor layer and a transparent protective film was prepared.

Accordingly, the radiation image storage panels having such phosphor layers as set forth in Table 1 were prepared.

TABLE 1

| | 1st Phosphor Layer | 2nd Phosphor Layer |
|---|---|---|
| Example 1 | Phosphor I | Phosphor II |
| Example 2 | Phosphor I | Phosphor III |

Further, a variety of radiation image storage panels in which the second phosphor layer has different thickness were prepared, varying the thickness of second phosphor layer within the range of 50–300 μm for each example.

COMPARISON EXAMPLES 1 THROUGH 3

The procedure of Example 1 were repeated except that a single phosphor layer having the same structure as the second phosphor layer of Example 1 was directly provided on the support without provision of the first phosphor layer, to prepare radiation image storage panels consisting essentially of a support, such phosphor layer as set forth in Table 2 and a transparent protective film.

TABLE 2

| | Phosphor Layer |
|---|---|
| Com. Example 1 | Phosphor I |
| Com. Example 2 | Phosphor II |
| Com. Example 3 | Phosphor III |

Further, a variety of radiation image storage panels in which the phosphor layer has a different thickness were prepared, varying the thickness of phosphor layer within the range of 50–300 μm for each comparison example.

The radiation image storage panels prepared as described above were evaluated on the sharpness of the image and the sensitivity according to the following test.

(1) Sharpness of image

The radiation image storage panel was exposed to X-rays at voltage of 80 KVp through an MTF chart and subsequently scanned with a He-Ne laser beam (wavelength: 632.8 nm) to excite the phosphor. The light emitted by the phosphor layer(s) of the panel and detected and converted to the corresponding electric signals by means of a photosensor (a photomultiplier having spectral sensitivity of type S-5). The electric signals were reproduced by an image reproducing apparatus to obtain a visible image on a recording apparatus, and the modulation transfer function (MTF) value of the visible image was determined. The MTF value was given as a value (%) at the spacial frequency of 2 cycle/mm.

(2) Sensitivity

The radiation image storage panel was exposed to X-rays at voltage of 80 KVp and subsequently scanned with a He-Ne laser beam (wavelength: 632.8 nm) to excite the phosphor. The light emitted by the phosphor layer(s) of the panel was detected by means of the above-mentioned photosensor to measure the sensitivity thereof.

The results of the evaluation on the radiation image storage panels are graphically shown in FIG. 3.

In FIG. 3:

Curve (A) shows a relationship between a relative sensitivity and a sharpness with respect to the radiation image storage panel of Example 1, Curve (B) shows a relationship between a relative sensitivity and a sharpness with respect to the radiation image storage panel of Example 2, Curve (C) shows a relationship between a relative sensitivity and a sharpness with respect to the radiation image storage panel of Comparison Example 1, Curve (D) shows a relationship between a relative sensitivity and a sharpness with respect to the radiation image storage panel of Comparison Example 2, and Curve (E) shows a relationship between a relative sensitivity and a shapness with respect to the radiation image storage panel of Comparison Example 3.

As is evident from the results shown in FIG. 3, the radiaition image storage panels according to the present invention which show Curves (A) and (B) respectively are improved in the sharpness in the case of having the same sensitivity, and improved in the sensitivity in the case of providing an image of the same sharpness, as compared with the conventional radiation image storage panels which show Curves (C) through (E) respectively.

EXAMPLES 3 AND 4 AND COMPARISON EXAMPLES 4 AND 5

The procedures of Example 1 were repeated except that the coating dispersions for the first phosphor layer and/or the second phosphor layer of Example 1 were mixed with a colorant (Bari Fast Blue No. 1605; manufactured by Orient Co., Ltd.) in such ratios as set forth in Table 3, to prepare radiation image storage panels consisting essentially of a support, the first phosphor layer and the second phosphor layer and a transparent protective film, in which the thickness of the second layer was varied.

TABLE 3

| | 1st Phosphor Layer | 2nd Phosphor Layer |
|---|---|---|
| Example 3 | $1:2 \times 10^5$ | — |
| Example 4 | $1:2 \times 10^5$ | $1:5 \times 10^5$ |
| Com. Example 4 | — | $1:5 \times 10^5$ |
| Com. Example 5 | $1:5 \times 10^5$ | $1:2 \times 10^5$ |

Notes: In Table 3, the color density of the phosphor layer is represented by a weight ratio between the colorant and the stimulable phosphor (colorant:phosphor).

The radiation image storage panels prepared as described above were evaluated on the above-mentioned sharpness of the image and sensitivity. The results of the evaluation on the radiation image storage panels are graphically shown in FIG. 4.

In FIG. 4:

Curve (F) shows a relationship between a relative sensitivity and a sharpness with respect to the radiation image storage panel of Example 3, Curve (G) shows a relationship between a relative sensitivity and a sharpness with respect to the radiation image storage panel of Example 4, Curve (H) shows a relationship between a relative sensitivity and a sharpness with respect to the radiation image storage panel of Comparison Example 4, Curve (I) shows a relationship between a relative sensitivity and a sharpness with respect to the radiation image storage panel of Comparison Example 5, Curve (A) shows a relationship between a relative sensitivity and a sharpness with respect to the radiation image storage panel of Example 1, and Curve (C) shows a relationship between a relative sensitivity and a shapness with respect to the radiation image storage panel of Comparison Example 3.

As is evident from the results shown in FIG. 4, the radiaition image storage panels according to the present invention which show Curves (A), (F) and (G) respectively are improved in the sharpness as compared with the conventional radiation image storage panels which show Curves (C), (H) and (I) respectively, when the comparison is made at the same sensitivity level basis. Further, it is evident that the radiation image storage panels according to the invention are improved in the sensitivity as compared with the conventional radiation image storage panels, when the comparison is made at the same sharpness level basis.

We claim:

1. A radiation image storage panel comprising a support having a support side and phosphor layers provided thereon which comprise a binder and a stimulable phosphor dispersed therein, characterized in that said phosphor layers comprise a first phosphor layer on said support side and a second phosphor layer provided on said first phosphor layer, and that the mean particle size of the stimulable phosphor contained in said first phosphor layer is smaller than the mean particle size of the stimulable phosphor contained in the second phosphor layer, said stimulable phosphor contained in said first phosphor layer being the same as said stimulable phosphor contained in said second phosphor layer.

2. The radiation image storage panel as claimed in claim 1, in which the mean particle size of the stimulable phosphor contained in the first phosphor layer is in the range of 0.5–10 μm, and the mean particle size of the stimulable phosphor contained in the second phosphor layer is in the range of 1–50 μm.

3. The radiation image storage panel as claimed in claim 2, in which the mean particle size of the stimulable phosphor contained in the first phosphor layer is in the range of 1–8 μm, and the mean particle size of the stimulable phosphor contained in the second phosphor layer is in the range of 4–30 μm.

4. The radiation image storage panel as claimed in claim 1, 2 or 3, in which the first phosphor layer is so colored as to absorb at least a portion of stimulating rays.

5. The radiation image storage panel as claimed in claim 4, in which the first phosphor layer is so colored that the mean absorption coefficient of said first phosphor layer in the wavelength region of the stimulating rays for the stimulable phosphors contained in the first phosphor layer and the second phosphor layer is higher than the mean absorption coefficient of said first phosphor layer in the wavelength region of the light emitted by the stimulable phosphors upon stimulation thereof.

6. The radiation image storage panel as claimed in claim 1, 2 or 3, in which both the first phosphor layer and second phosphor layer are so colored as to absorb at least a portion of stimulating rays, and the color density of said first phosphor layer is higher than the color density of said second phosphor layer.

7. The radiation image storage panel as claimed in claim 6, in which both the first phosphor layer and second phosphor layer are so colored that the mean absorption coefficients of said phosphor layers in the wavelength region of the stimulating rays for the stimulable phosphors contained in the first phosphor layer and second phosphor layer are higher than the mean absorption coefficients of said phosphor layers in the wavelength region of the light emitted by the stimulable phosphors upon stimulation thereof, respectively.

8. The radiation image storage panel as claimed in claim 1 in which the first phosphor layer and second phosphor layer contain a divalent europium activated alkaline earth metal fluorohalide phosphor.

9. The radiation image storage panel as claimed in claim 8, in which the divalent europium activated alkaline earth metal fluorohalide phosphor is a divalent europium activated barium fluorobromide phosphor.

10. A radiation image recording and reproducing method comprising the steps of:

subjecting first and second stimulable phosphor layers to a radiation having passed through an object or having radiated from an object to cause the stimulable phosphors in said first and second phosphor layers to absorb said radiation, said stimulable phosphor contained in said first phosphor layer being the same as the stimulable phosphor contained in said second phosphor layer, the mean particle size of the stimulable phosphor contained in said first phosphor layer being smaller than the mean particle size of the stimulable phosphor contained in said second phosphor layer;

exciting said stimulable phosphors contained in said first and second phosphor layers with an electromagnetic wave to release radiation stored in said stimulable phosphors contained in said first and second phosphor layers as emitted light; and detecting said emitted light.

* * * * *